US011375797B2

(12) United States Patent
Forbes

(10) Patent No.: US 11,375,797 B2
(45) Date of Patent: Jul. 5, 2022

(54) SYSTEM CASE FOR STORING AND CARRYING COSMETIC ESSENTIALS

(71) Applicant: Raven Forbes, McKinney, TX (US)

(72) Inventor: Raven Forbes, McKinney, TX (US)

(73) Assignee: Raven Forbes, McKinney, TX (US)

( * ) Notice: Subject to any disclaimer, the term of this patent is extended or adjusted under 35 U.S.C. 154(b) by 200 days.

(21) Appl. No.: 16/812,653

(22) Filed: Mar. 9, 2020

(65) Prior Publication Data

US 2021/0274911 A1 Sep. 9, 2021

(51) Int. Cl.
*A45D 33/00* (2006.01)
*A45D 40/24* (2006.01)
*A45D 33/26* (2006.01)

(52) U.S. Cl.
CPC ..... *A45D 40/24* (2013.01); *A45D 33/008* (2013.01); *A45D 33/26* (2013.01); *A45D 2033/001* (2013.01)

(58) Field of Classification Search
CPC ..... A45D 2033/001; A45D 33/26; A45D 33/008; A45D 40/24; A45D 42/02; A45D 1/02
USPC ..... 206/581
See application file for complete search history.

(56) References Cited

U.S. PATENT DOCUMENTS 5,005,697 A * 4/1991 Jimbo ..... A45D 40/00 206/235
8,978,886 B2 * 3/2015 Ziemba ..... A45C 11/182 206/320
2018/0263361 A1 * 9/2018 Langdon ..... A45D 40/24

* cited by examiner

*Primary Examiner* — King M Chu
(74) *Attorney, Agent, or Firm* — Darcell Walker

(57) ABSTRACT

A cosmetic case has a generally rectangular shape with an internal space receive and hold multiple cosmetic cartridges containing various makeup products. This case has a slim-line design to facilitate easy storage and transport. Cosmetic cartridges can be inserted into the case from multiple and stored depending on the particular embodiment of the case. A securing means inside the case prevents inserted cartridges from dislodging from the case until desired by the user. The cosmetic case and system provides the advantage and ability to store cosmetic cartridges of different shapes and dimension in the case for optimal use. This invention enables a user to efficiently store and carry various cosmetic products for quick use especially when one desires a makeup touch up.

14 Claims, 7 Drawing Sheets

SYSTEM CASE FOR STORING AND CARRYING COSMETIC ESSENTIALS

FIELD OF THE INVENTION

This invention relates to a system and case for storing, carrying and using cosmetics. In particular, this invention relates to a portable case that facilitates efficiently arranging and storing various cosmetics for use. The present invention further relates to a system of miniature size cosmetic cartridges of various dimensions optimal arrangement and storage of cosmetics in the portable cosmetic case.

BACKGROUND

The application of cosmetics is a daily routine for many people. This use of cosmetics and makeup is for beauty purposes and appearance purposes. Also for some women the use of cosmetics enhances self-esteem. People generally apply cosmetics before leaving home. Whether one lives in an urban, suburban or rural area, the image of the home bathroom counter crowded and cluttered with makeup products can be the same. This clutter and mass disorganization can leave some people feeling overwhelmed. One possible reason for makeup clutter in the bathroom or bedroom is that different people use different amounts of makeup. As a result, some people have more makeup to create the clutter.

This problem of clutter is not just experienced at one's home. In a marketing study of cosmetic consumers, nearly unanimous response about makeup application routines was that there was a need to reapply makeup throughout the day. Participants described that they would carry "the essentials" (cosmetics) around with them all day so that they would be able to reapply makeup if necessary. Some described their situations as "living out of a bag" because of a need to carry everything with them all day. The reasoning behind this lifestyle choice tends to be because participants switch between multiple environments before going home late at night.

As mentioned, a conventional solution to having makeup to do touch ups during various times of the day is to carry the needed cosmetics in a bag or purse. Some people expressed a pain point, based on the sheer size of the bag, around carrying a large makeup bag with the products needed to appropriately touch up the sheer size.

Research shows that women generally fall into two distinct categories: morning makeup routines and mid-day touch up routines. Morning makeup routines near unanimously include creating a foundation or base when applying the makeup to achieve a "basic everyday look." Touch up routines are done on-the-go at work during the day to prep for after-work occasions or for important business meetings. Touch up routines include the highest opportunity for application of bold colors given that the usual occasions are after work or weekend activities. Make up touch up routines generally include usage of the following products: Mascara, Lipstick, Powder (foundation that is usually only applied once per day in the morning), Eye liner and Eye shadow. To carry these products, women often carry "work bags" or "work backpacks" on weekdays. They often switch bags on the weekend to a smaller "weekend" or "after work" bag. Switching between various bags has undesirable consequences. Spending time to prioritize items to transfer of products from a full-on kit to a weekend or after workbag. One situation women regret is lugging around make up kits for frequent make up touch ups. One other configuration used by women is a makeup pallet with multiple cosmetic products arranged in the pallet in a manner similar to a painter using a painting pallet. This pallet can contain in excess of 20 different makeup products. However, this pallet product is not convenient for transport.

U.S. Pat. No. 10,034,532 to Zhan describes a cosmetic case including an outer case assembly and an inner disk assembly. The outer case assembly includes a case body and a case cover the case body includes a first accommodation chamber having an opening. The inner disk assembly includes a disk body, a disk cover, an outer slot, and a seal ring. The disk body includes a second accommodation chamber for accommodating cosmetics. The case cover is hinged to the case body and adapted to open and close the opening of the first accommodation chamber. The inner disk assembly is disposed detachably in the first accommodation chamber. The disk cover is hinged to the disc body and adapted to open and close the opening of the second accommodation chamber. The outer slot is positioned around the outer sidewall of the second accommodation chamber and the seal ring is housed in the outer slot.

U.S. Pat. No. 10,206,483 to Gajjar describes a cosmetic case according to the present invention for selectively receiving miniature cosmetic items includes a lower case portion having a bottom wall and a continuous side wall extending upwardly from a perimeter edge of the bottom wall, the lower case having an open top and defining an interior area. The cosmetic case includes an upper case portion pivotally coupled to a rear section of the side wall of the lower case portion and being selectively movable between open and closed configurations. A front section of the side wall defines a plurality of apertures configured to selectively receive the tubular cosmetic items into the interior area. The cosmetic case includes a spring loaded assembly configured to naturally urge the cosmetic items out of the interior area. A magnetic shelf in the lower case portion configured to support magnetic cosmetic receptacles.

U.S. Pat. No. 6,796,431 to Goldring describes a cosmetics package comprising a base unit having upper storage means, lower storage means and side walls and a lid movable relative to the base unit between open and closed positions, the upper storage means having locating means for locating a plurality of first cosmetics products in defined positions which are readily accessible when the lid is in its open position but which are inaccessible when the lid is in its closed position, the lower storage means comprising a plurality of cavities opening into the, or at least one of the, side walls and extending beneath the upper storage means for receiving second cosmetics products. The cosmetics package enables individual cosmetics products to be accessed easily for immediate application to a user.

U.S. Pat. No. 6,886,695 to Karoly describes methods and systems for organizing cosmetics are disclosed. One cosmetic case system includes a body having a series of compartments that lock cosmetic containers into the compartment for ease of storage and use. In one set of embodiments, the containers are removable from the cosmetic case. In other embodiments, the containers are an integral part of the cosmetic case. The compartments include ridges that aid in locking the cosmetic containers into the compartments. Several of these cosmetic case bodies can be alternatively stacked so that storage capacity is increased. The cosmetic case can include a mirror on a surface of the body. The case can also include a hinged surface for additional storage.

U. S. Patent Application 20160324297 to Moore describes a lipstick storage assembly including a housing that has an opening to access a plurality of discrete lipstick spaces. Each of the discrete lipstick spaces insertably receives a tube of lipstick. A base is movably coupled to the housing. An extender is positioned within the base. The extender urges a selected one of the tubes of lipstick upwardly in the discrete lipstick spaces. The extender is in mechanical communication with the base. The base is rotatable relative to the housing such that the extender engages the selected tube of lipstick.

U. S. Patent Application 20160135567 to Kamboj describes a multiple cosmetic holder and applicator including a plurality of cosmetic cartridges that receive standard cosmetics therein. The cartridges include an upper magnet disposed within the opening, and a lower annular groove on the cylindrical body. A main body holds the plurality of cosmetic cartridges and includes a base with depressions which include a lower magnet therein and which receive the cosmetic cartridges, locking mechanisms which interface with the annular groove of the cartridges to lock the cartridges within the depressions, and an outer case movable relative to the main body which has a pressable button that unlocks the locking mechanism from the cartridge. A removable cap covers the main body, the cartridges, and the standard cosmetics. A selector tube extends through an aperture in the cap to remove the cartridge when the button is pressed and the locking mechanism is unlocked.

U. S. Patent Application 20140299151 to Stroud describes a modular cosmetic container system is provided to enable a user to organize, create, and substitute customizable cosmetic trays detachably retained within a cosmetic storage system. The present invention utilizes the customizable tray assemblies as a means to store particular combinations of cosmetic products. Each cosmetic product is stored within specially designed receptacles to create a unique set of cosmetic products. These unique sets can be placed within the cosmetic storage system allowing for facilitated transfer and improved customization for user's who may need to frequently carry large collections of cosmetic products. The modular cosmetic container system comprises a housing assembly and at least one tray assembly. The housing assembly is the structural body that functions as a storage location for retaining the at least one tray assembly. The at least one tray assembly is the customizable storage component that retains a plurality of cosmetic products or cosmetic applicator.

U. S. Patent Application 20050081877 to Byun describes a portable cosmetics case includes a housing having a receipt member for cosmetic set and cosmetics to carry it and a cover, the receipt member containing the cosmetic set or the cosmetics capable of raising the above top portion of the housing to permit selection of any one to be required among the cosmetic set or the cosmetics when the cover is opened, and being entered into the housing when the cover is closed, thereby attaining simple and convenient carrying and storage thereof.

These products show various ways to store and carry cosmetics. However, the products described in these publications still lack the flexibility to arrange various cosmetics cartridges of different sizes and shapes unique configurations in a case. Current case designs require cartridges to have linear same size slots. This configuration can make it difficult to store some combinations of cosmetic cartridges with different types of geometric configurations. There remains a need for a cosmetic case that can store various cosmetic cartridges having different geometric configurations and have dimensions for easy storage.

SUMMARY

The present invention provides a device and system for storing reduced quantities of cosmetics for use. The invention has a cosmetic storing case with a slim line configuration to facilitate convenient carrying of the case. The case further provides the capability to receive inserted cosmetic cartridges of various geometric shapes. With the present invention, a user can have a systematic arrangement of cosmetics conveniently stored in a compact case. The cosmetic cartridges of various geometric shapes can be arranged and inserted into the case in configurations that provide optimum storage of cosmetics. A user is not locked into specific cartridges having to fit in specific cartridge slots. At any particular time, the user has the capability to store cosmetic cartridges for preferred cosmetic. The present invention also has a means to secure the cosmetic cartridges in the case to prevent cartridge movement in the case and to prevent cartridges from dislodging and coming out of the case.

A preferred use of the device and system of the present invention is when a user wants to do a cosmetic touch up during the day. For this purpose the small quantity cosmetic cartridges provide easier storage than conventional size cosmetic products.

DETAILED DESCRIPTION OF THE INVENTION

This invention is a cosmetic case for storing and carrying makeup cosmetics. One embodiment of this invention comprises the concept of a "credit card shaped" all-in-one makeup holster with two rows of product. Ideally, this makeup holster would be approximately one-half inch in thickness. The first row can include space for products such as a thin lipstick, an eye liner and mascara and eye shadow cartridges. The second row can allow for a thin powder compact and cotton applicator products. On the large side of the "credit card" case can be a mirror to aid in makeup reapplication for on the go situations. One can easily insert the makeup cosmetic cartridges into and retrieve the cartridges from the case. This approach also makes it easier to replace cartridges. One means to secure the cartridges in place in the cosmetic case is with a small phone-safe magnet. Other cartridge securing means are available such as a screw mechanism to lock the cartridges in place once they are inserted into the case. The case product and separate cartridges can be available as separate products. However, case and individual cosmetic cartridges can combine to form a system for storing and carrying cosmetic products.

Figure 1:
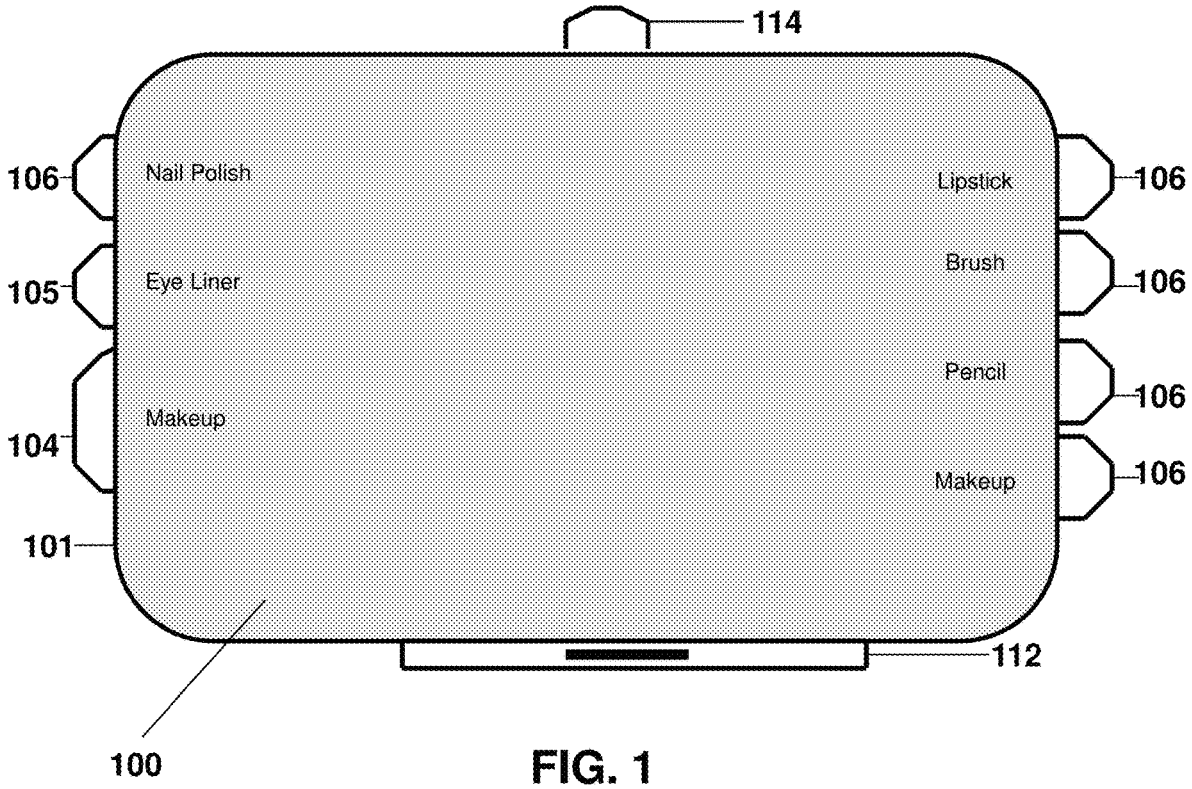
FIG. 1 is a top view of the beauty essentials cosmetic case of the present invention.

The concepts of the present invention are illustrated in the figures. FIG. 1 is a top view of the beauty essentials cosmetic case of the present invention. As shown, this case 100 can have a generally rectangular shape. This case has a top side 101 and a bottom side that are attached such that they form a case with an internal space for storage of the cosmetic cartridges. Openings at the edges 103 of the case provide access for insertion of the cosmetic cartridges 104, 105 and 106 into the case 100. As shown, the case designs can have openings on each side of the case or an opening on a single side of the case. To facilitate easier transport of the case 100 a hook or keyhole type structure 114 can attach to the topside of the case.

Figure 2:
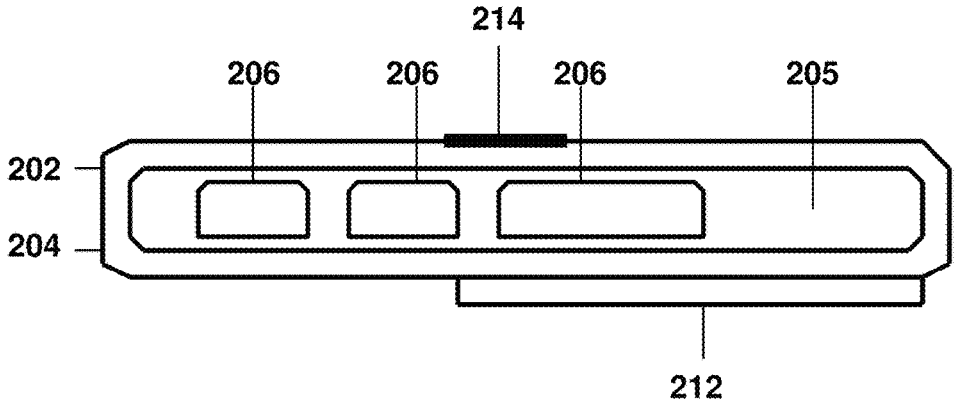
FIG. 2 is a side cross-section view of cosmetic case showing various cosmetic cartridges inserted into the cosmetic case.
Figure 3:
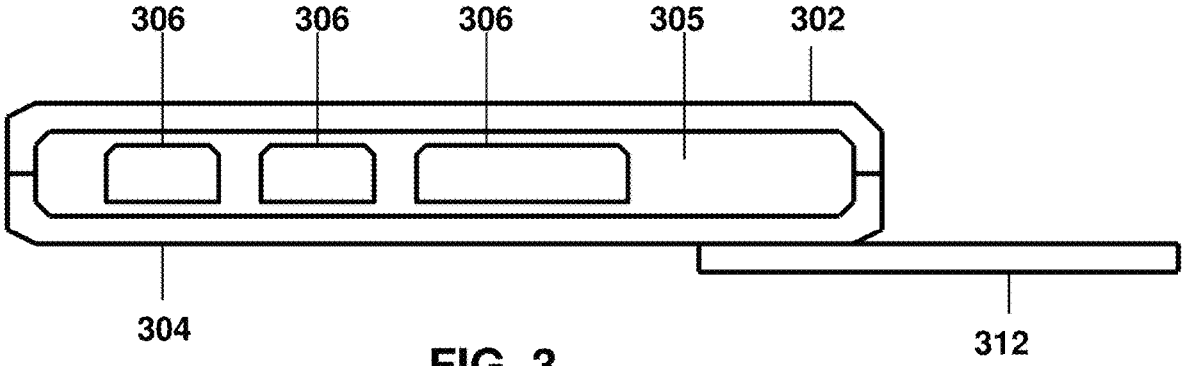
FIG. 3 is a side cross-section view of cosmetic case showing various cosmetic cartridges inserted into the cosmetic case with the window extended.

A cross-section view of the side of the cosmetic case shown in FIG. 2 illustrates various cosmetic cartridges inserted into the cosmetic case. As shown the cosmetic case can comprise a top side section 202 and a bottom side section 204 that come together to form the case of the present invention. The joining of these two sections creates the internal space 205 for insertion of cosmetic cartridges. A mirror 212 can be slidably attached to the bottom side section 204 of the case. Also shown are makeup cartridges 206 inserted into the internal space 205 of the case. Each makeup cartridge contains a portion of a different makeup product. These make up cartridges 206 can be of various sizes and shapes. Also for the purpose as the hook 114 of FIG. 1, a magnetic element 214 can attach to the surface of the case. This magnet can attach to a metal element on a purse or pocket book of the user for convenient transport and retrieval. FIG. 3 shows the same side cross-section view of the case. In an alternate embodiment to the case in FIG. 2, the case can comprise separate top 302 and bottom 304 sides. This view again illustrates the topside 302 and bottom side 304 sections of the case. Again, makeup cartridges of various sizes can be inserted into the internal space 305. In addition, in the configuration, the attached slidable mirror 312 is in the extended position to assist the user in properly applying makeup.

Figure 4:
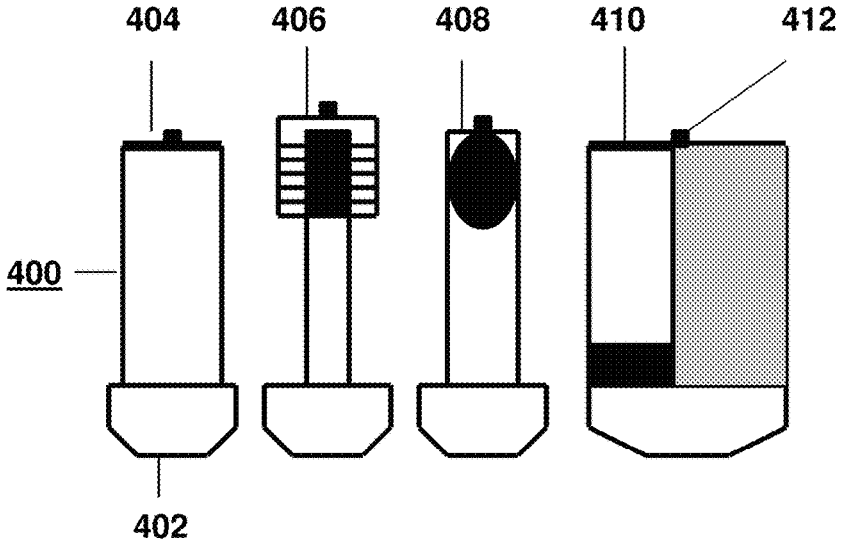
FIG. 4 is a top view of various cosmetic cartridges for insertion into the cosmetic case, the cosmetic cartridges containing different for cosmetics.

In the system of this invention, individual cartridges contain various cosmetics that are inserted into the cosmetic case. FIG. 4 is a top view of these various cosmetic cartridges. Shown are four different cosmetic cartridge types. A cartridge comprises a body 400, which can be some form of trough that contains the cosmetic material. Attached to the cartridge body at the front end is a cap 402 that will serve as a handle to insert and retrieve the cartridge from the cosmetic case. Attached at the back end 404 of the cartridge can be some form of magnet 412 or magnetic material to facilitate securing the cartridge to the cosmetic case when inserted into the case. Cartridge 406 shows a cartridge with bristles 406. Cartridge 408 shows a cartridge with a different configuration. Cartridge 410 shows a cosmetic cartridge with larger width dimensions from the other cartridges. All of the shown cartridges have a cap 402 at the front end and some form of magnet or magnetic material 412 for securing the cartridges into the cosmetic case.

Figure 5:
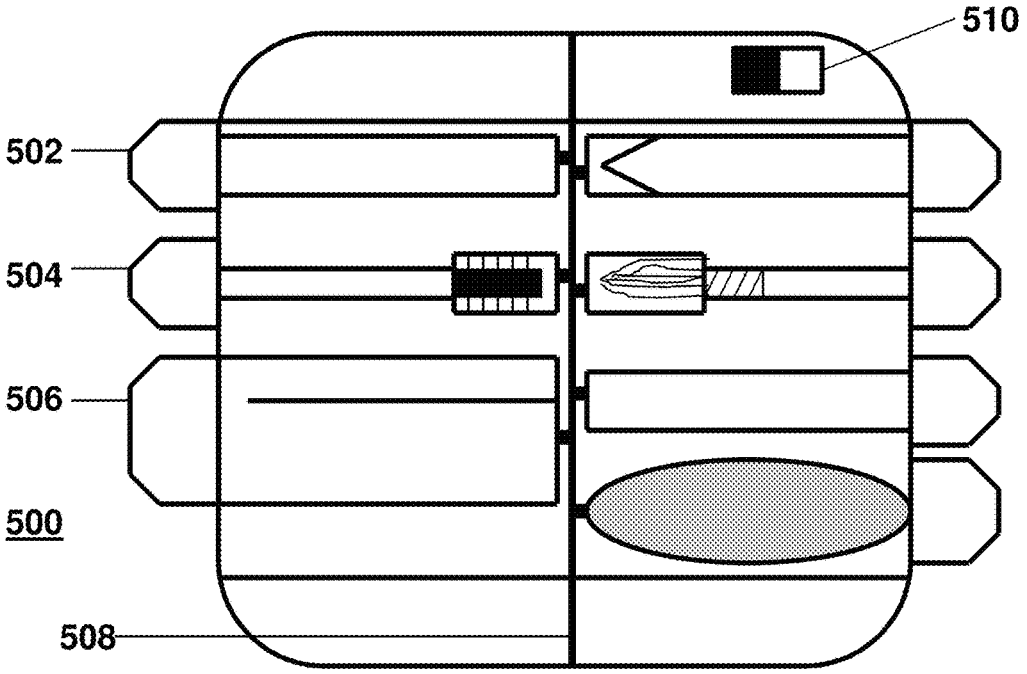
FIG. 5 is a top cross-section view showing a configuration of various cosmetic cartridges stored in the cosmetic case of the present invention.

In the present invention, the cosmetic case houses cosmetic cartridges inserted into the cosmetic case. FIG. 5 shows a cross-section view of a configuration of various cosmetic cartridges stored in the cosmetic case of the present invention. This cosmetic case 500 has a generally rectangular shape to resemble a credit card. Cartridges such as 502, 504 and 506 are inserted into the space in the cosmetic case. As mentioned, these cartridges can vary in dimensions and shape. A metal rod 508 positioned in the center of the case extends the length of the case creating two sides. This rod can be magnetic for the purpose of securing cartridges inserted into the case. In addition, the magnetic material attached to the end of the cartridges will attract the magnetic rod and attach to it. The magnetic force for both the cartridges and the rod is sufficient to secure the cartridges in the case, but not strong as to make retrieval of the cartridges difficult. In alternate embodiment, the securing means for the cosmetic cartridges can be some form of latch system to lock the cartridges into place. A switch 510 can serve to initiate the locking process.

Figure 6:
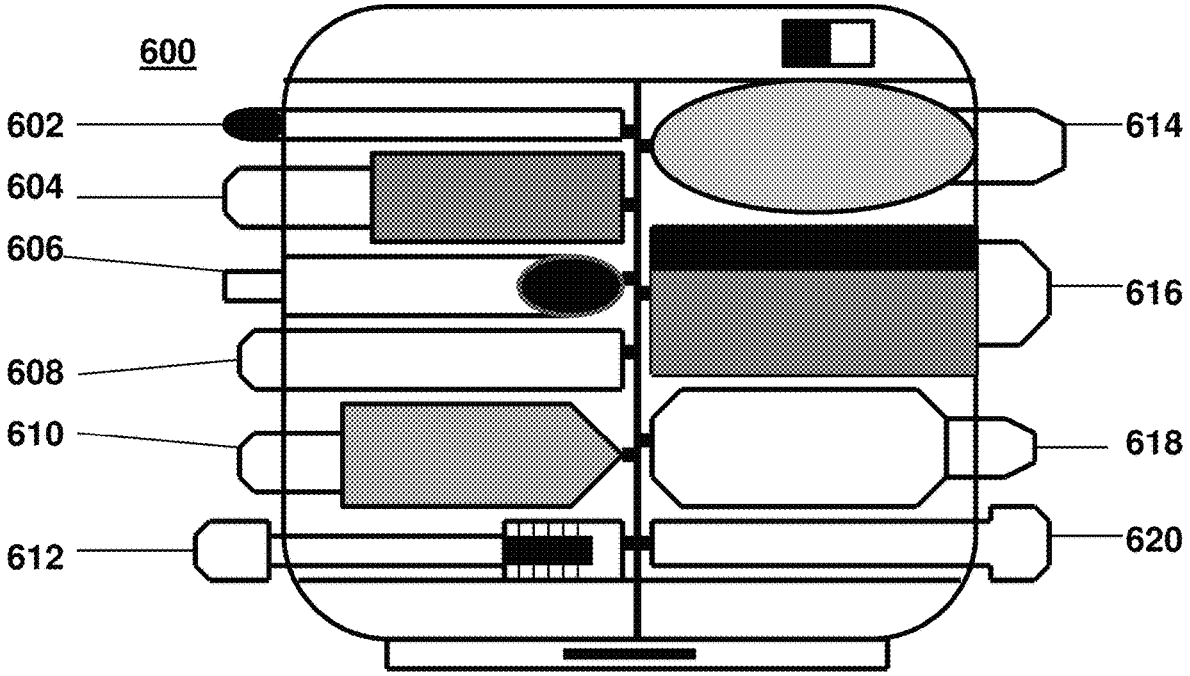
FIG. 6 is a top cross-section view showing an alternate configuration of various cosmetic cartridges stored in the cosmetic case of the present invention.

FIG. 6 is a top cross-section view showing an alternate configuration of various cosmetic cartridges stored in the cosmetic case of the present invention. Depending on the size of the cosmetic cartridges, there can be various combinations of cartridges inserted into the cosmetic case. In contrast to FIG. 5, FIG. 6 shows several additional cosmetic cartridges inserted into the case. On one side of the case 600 are cartridges 602, 604, 606, 608, 610 and 612. On the other side of the case are cartridges 614, 616, 618, and 620. As shown in this combination, there are six cartridges on one side and four cartridges on the other side for a total of ten cartridges stored in the cosmetic case. Because of the open internal space 205, a user has the flexibility to combine inserted cartridges for efficient storage in the cosmetic case.

Figure 7:
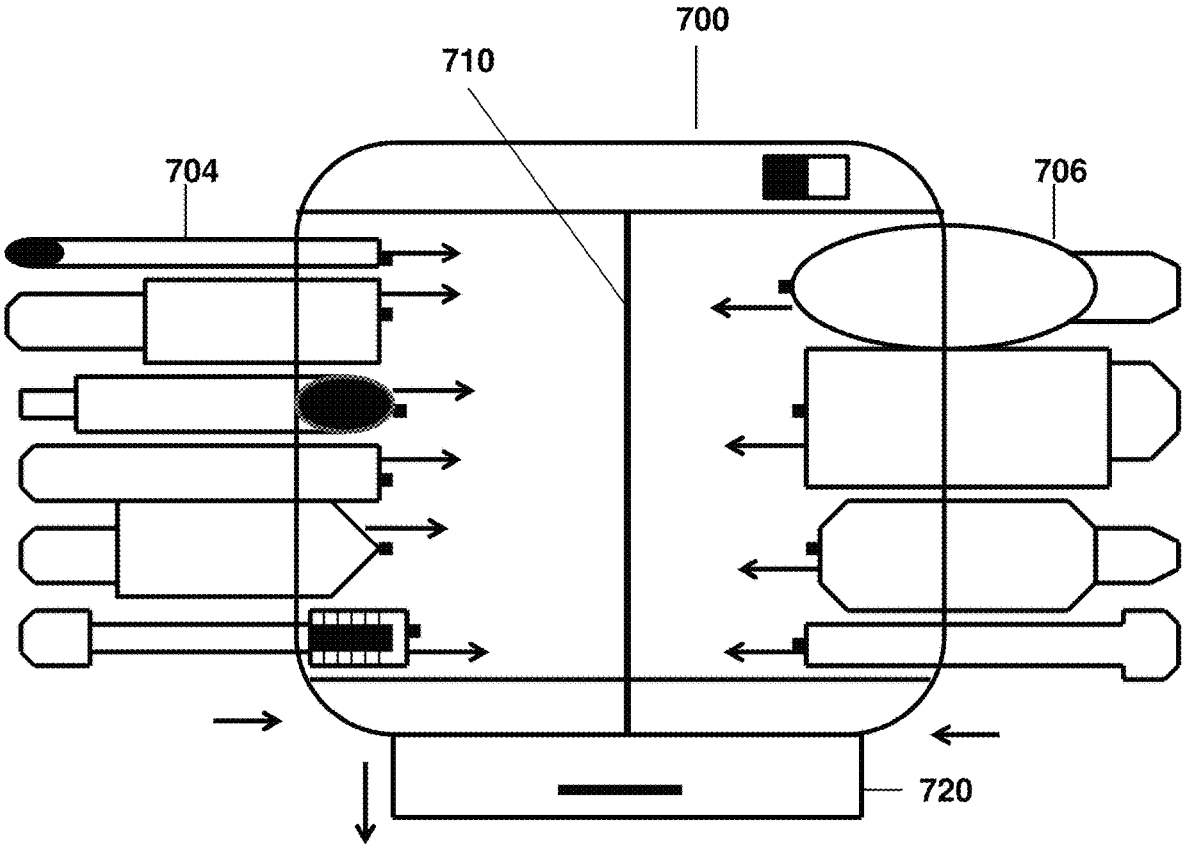
FIG. 7 is a top cross-section view showing the direction of the insertion of cosmetic cartridges into the cosmetic case of the present invention.

FIG. 7 is a top cross-section view showing the direction of the insertion of cosmetic cartridges into the cosmetic case of the present invention. As shown, several components in the system of the invention are slidably attached to the cosmetic case 700 for movement into and out of the case. Arrows show the direction of the cosmetic cartridges such as 704 and 706 move inward toward the metal/magnetic material 710. Also shown is the outward direction from the case of the mirror 720.

Figure 8:
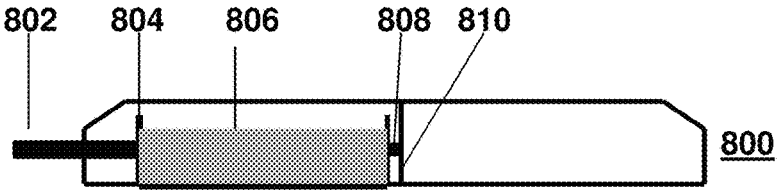
FIG. 8 is a side cross-section view of a cosmetic cartridge inserted into the cosmetic case of the present invention.

The present invention also incorporates cartridges containing portions of cosmetics. FIG. 8 is a side cross-section view of a cosmetic cartridge 800 inserted into the cosmetic case of the present invention. This cartridge has a handle (cap) 802 attaches to a body section 804 that contains a portion of a specific cosmetic 806. The handle enables the user to insert into and retrieve the cartridge from the case. At the end of the cartridge body 804 opposite the handle end is a magnet 808. This magnet will attach to the magnetic bar element 810. As previously stated, this cartridge slidably attaches to the cosmetic cartridge 800 for easy retrieval and insertion.

Figure 9:
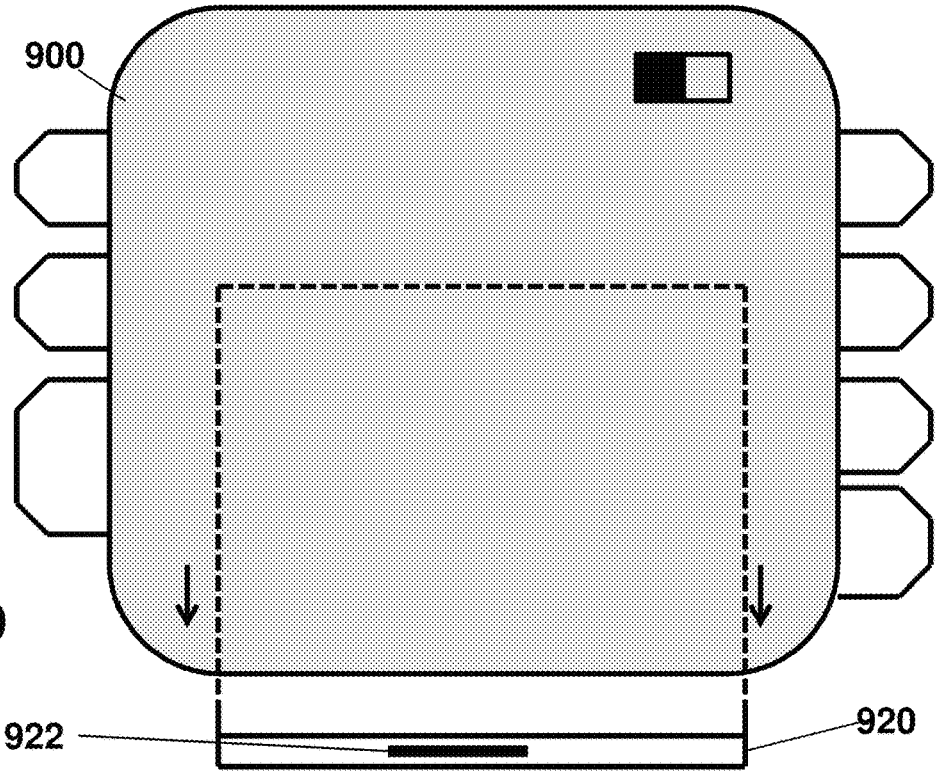
FIG. 9 is a top cross-section view of a retractable mirror stored in cosmetic case of the present invention.
Figure 10:
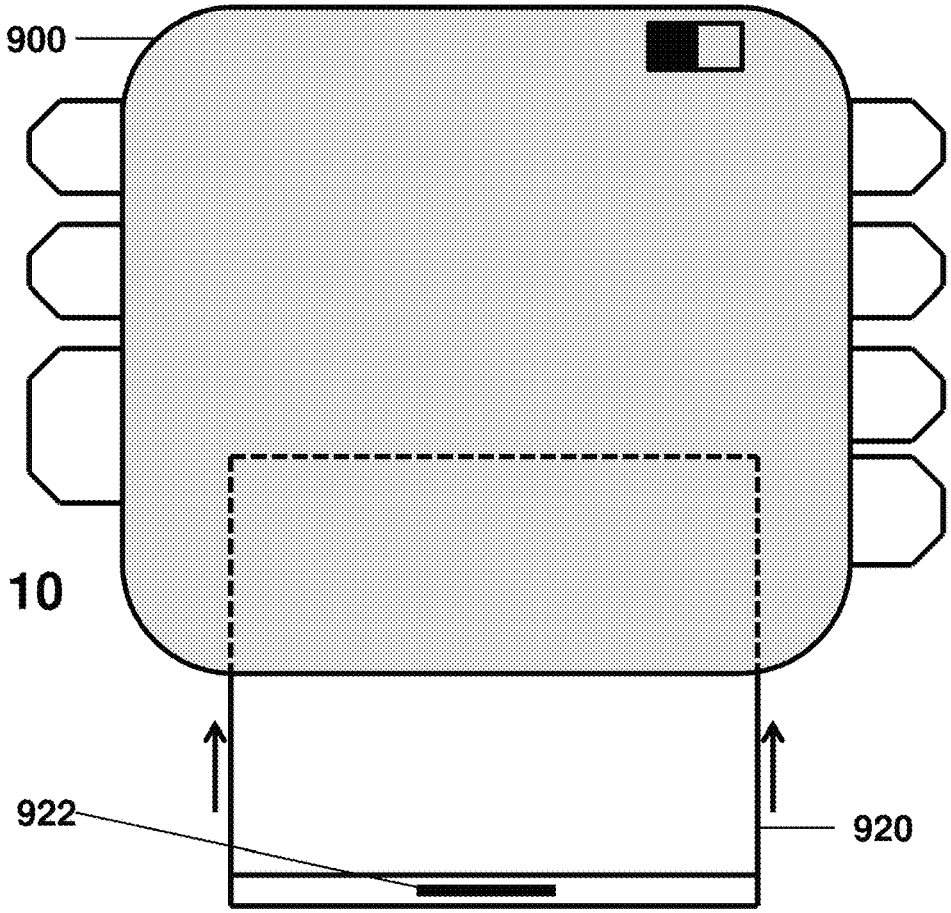
FIG. 10 is a top-cross-section view of a retractable mirror extended from the cosmetic case of the present invention.

FIGS. 9 and 10 show top cross section views of the attached mirror 920 in the retracted and extended positions. In FIG. 9 is the mirror 920 is in the retracted position underneath the cosmetic case 900. FIG. 10 shows the mirror in an extended position. To facilitate easier retraction and insertion of the mirror, a groove 922 can be embedded into the mirror, near the edge of the mirror. The mirror can completely detach from the case 900. This will enable a person to easily use the mirror during the application of makeup.

Figure 11:
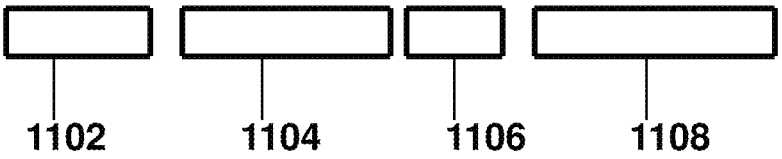
FIG. 11 is a front cross-section view of the various shapes of cosmetic cartridges for insertion into the cosmetic case of the present invention.
Figure 12:
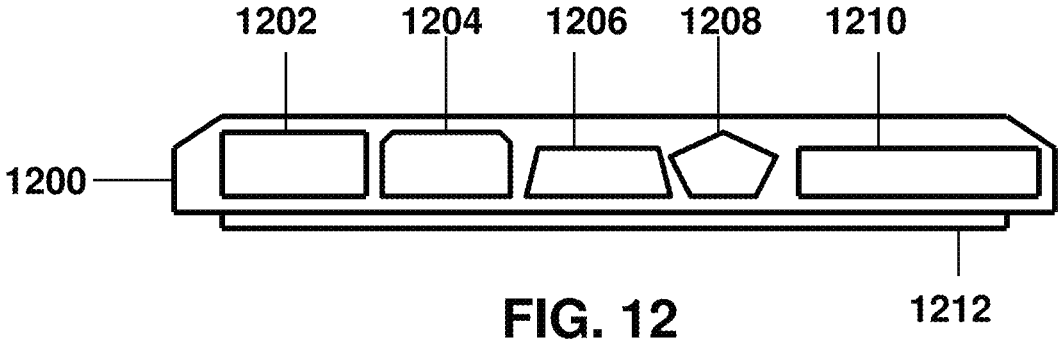
FIG. 12 is a front cross-section view of a configuration of cosmetic cartridges of various shapes and dimensions inserted into the cosmetic case of the present invention.
Figure 13:
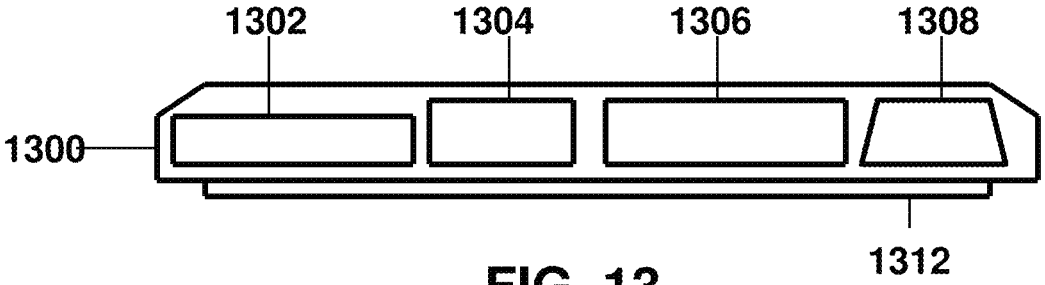
FIG. 13 is a front cross-section view of an alternate configuration of cosmetic cartridges of various shapes and dimensions inserted into the cosmetic case of the present invention.

As shown, makeup cartridges will be of different dimensions. The internal space 205 enables various combinations of different shaped cartridges to be inserted into the cosmetic case as desired by the user. FIG. 11 shows a front cross-section view of the various shapes of cosmetic cartridges 1102, 1104, 1106 and 1108 for insertion into the cosmetic case of the present invention. These cartridges appear to all have the same shaped end or cap. FIG. 12 shows a configuration of cosmetic cartridges 1202, 1204, 1206, 1208 and 1210 of various shapes and dimensions inserted into the cosmetic case of the present invention. As shown, depending on the dimensions of the cartridges inserted into the case, different numbers of cartridges will fit into the case. FIG. 13 shows of an alternate combination of cosmetic cartridges 1302, 1304, 1306 and 1308 of various shapes and dimensions inserted into the cosmetic case of the present invention.

Figure 14:
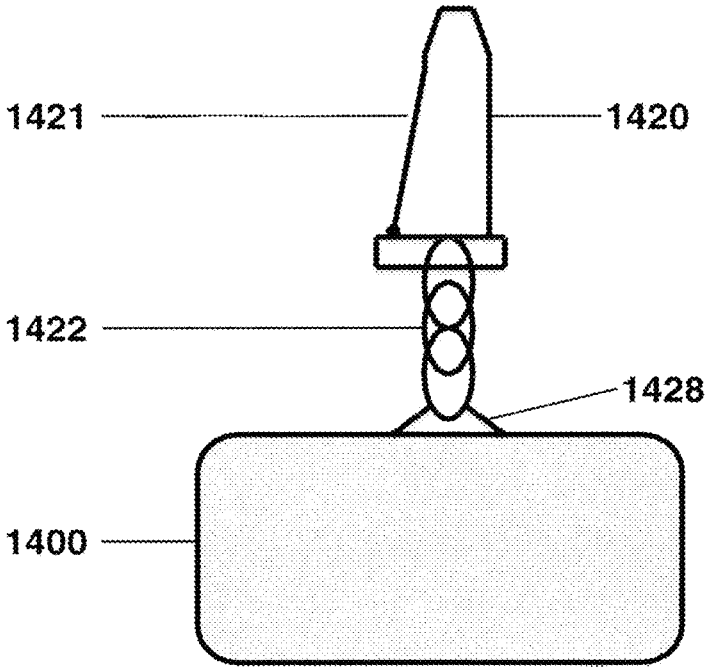
FIG. 14 is a view of the cosmetic case of the present invention attached to a clip for attachment to a purse or other item for transport and optimal access.

The present invention can have alternate embodiments that provide for optimal transport of the case. These features can enable a user to attach the case to items such as a cellular telephone, handbag, purse of backpack. FIG. 14 shows an embodiment of a system for attaching and securing the case 1400 to a purse, bag, backpack or other item one may carry. This system can comprise a keyhole or hook item 1428 that is attached to the case. This hook item can engage a chain 1422. This chain can also attach to a conventional hook/clamp item 1420. This clamp can have a piece 1421 that pivots to create the opening through which the clamp can engage and attach to an item. In an alternate to this embodiment, a tether can attach the case to the personal item. The tether can be of elastic or plastic material.

Figure 15:
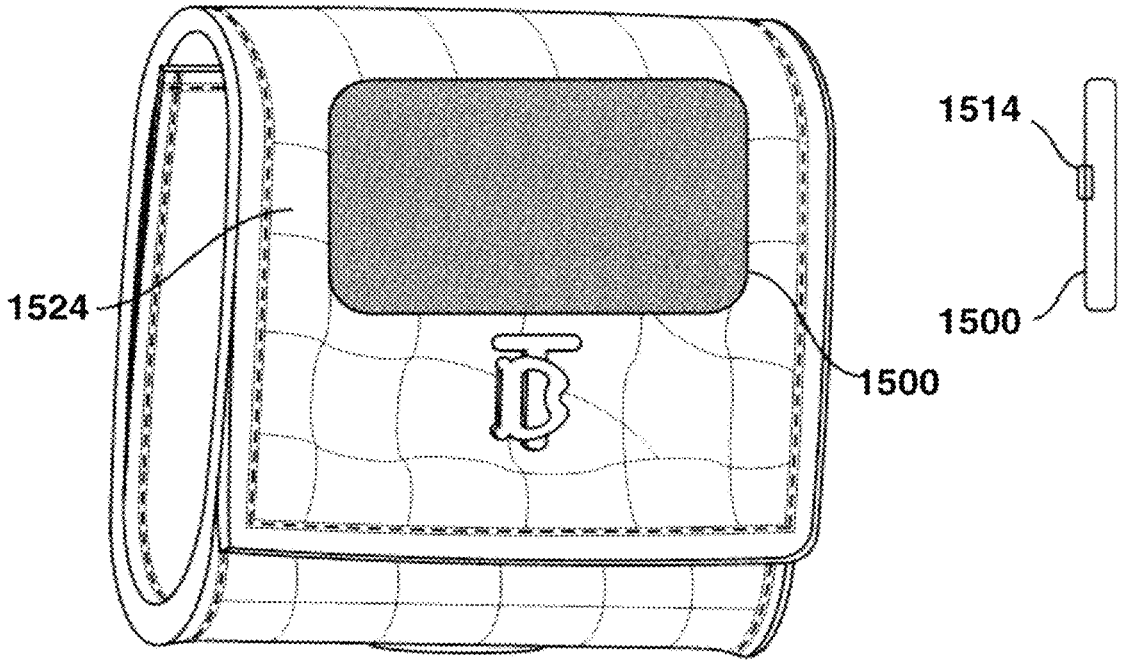
FIG. 15 is a view of the cosmetic case of the present invention attached to a purse item using a magnet system to secure the attachment.

FIG. 15 shows another alternate embodiment in which the cosmetic case 1500 of the present invention attaches to a purse/pocketbook item 1524. This embodiment incorporates a magnet system to attach to the case to the purse. Magnet 1514 attached to the inner surface of the case can attach to a magnet or metal item already affixed to the purse. As the magnet 1514 attracts and engages the metal item of the purse, the case becomes attached and secured to the purse for easier transport.

In addition to the above-mentioned embodiments for attaching the cosmetic case of the present invention to a personal item of a user, the cosmetic case can have an adhesive material attached to its surface. This adhesive strip can be a material such as VELCRO™. In addition, the user's personal item will also contain an adhesive material that engages the material on the cosmetic case to secure the case to the user's personal item such as a purse or cellular telephone.

The improved cosmetic case and system of the invention provides significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention.

I claim:

1. A portable cosmetic system for storing and carrying cosmetics comprising:

cosmetic case having a rectangular elongated shape with a top section and a bottom section, the top section and bottom section having an internal surface and external surface and edges of both sections that come together, the internal surfaces of said top and bottom sections each having concave shapes that form internal space between the top and bottom sections when edges of said top and bottom come together to enclosed any contents of said cosmetic case;

security structure in the internal space for securing cosmetic cartridges in the cosmetic case;

a plurality cosmetic cartridges for insertion into said cosmetic case, said plurality of cosmetic cartridges being cosmetic materials and cosmetic utensils; and comprising a mirror slidably attached to an external surface of said cosmetic case, said mirror being able to be extended outward from cosmetic casing and retracted to said cosmetic case.

2. The portable cosmetic system as described in claim 1 wherein said security structure is a magnetic bar.

3. The portable cosmetic system as described in claim 2 wherein said cosmetic cartridge further comprises a cosmetic section with an internal end and an external end, said internal end having a magnetic attached to it, said magnetic to interact with said magnetic strip for securing a said portable cosmetic cartridge to said portable cosmetic case.

4. The portable cosmetic system as described in claim 1 wherein said right and left sides of the cosmetic casing having opening for insertion of cosmetic cartridges for storage.

5. The portable cosmetic system as described in claim 1 wherein said top and bottom sections of said cosmetic case form one single piece.

6. The portable cosmetic system as described in claim 1 wherein said plurality cosmetic cartridges comprise cartridges of different dimensions.

7. The portable cosmetic system as described in claim 3 wherein said plurality cosmetic cartridges further comprises a handle connected to said external end of said cartridge, said handle capable of facilitating extraction and insertion of, said cosmetic cartridges from said cosmetic case.

8. A portable cosmetic system for storing and carrying cosmetics comprising:

cosmetic case having a rectangular elongated shape with a top section and a bottom section, and left and right sides, the top section and bottom section having an internal surface and external surface, the internal surfaces of said top and bottom sections each having concave shapes that form internal space between the top and bottom sections;

a security structure in the internal space of said cosmetic case for securing cosmetic cartridges in the cosmetic case, said security structure having a security bar positioned in the internal space of said cosmetic case, the security bar having groove therein; cosmetic cartridges having a cosmetic section with a internal end and an external, the internal end having a hook device attached thereto for engaging the groove in the security bar, said cosmetic cartridge also having a turnable handle attached to the external end of the cosmetic cartridge, the turnable handle being able to rotate to enable the hook to engage the groove in the security bar for securing a cosmetic cartridge in said cosmetic case; and a plurality cosmetic cm artrid es of varying shapes for insertion into said cosmetic casing, said cartridges containing cosmetic materials.

9. The portable cosmetic system as described in claim 1 further comprising an attachment system for attaching said cosmetic case to another personal item of a user for easier transport and retrieval.

10. The portable cosmetic system as described in claim 9 wherein said attachment system further comprises:

a first circular element forming a loop and attached to an edge of the cosmetic case;

two or more circular links attached to each other to form a chain element having one end attached to said first circular element; and a clamp device attached to said chain at an end opposite said first circular element, said clamp device facilitates attaching said cosmetic case to a personal item of a user.

11. The portable cosmetic system as described in claim 9 wherein said attachment system further comprises a magnet element attached to a surface of said cosmetic case and a metal material attached to a personal device to which a user desires to attach said cosmetic case.

12. The portable cosmetic system as described in claim 9 wherein said attachment system further comprises an adhesive material attached to a surface of said cosmetic case and an adhesive material attached to a personal device to which a user desires to attach said cosmetic case.

13. The portable cosmetic system as described in claim 9 wherein said attachment system further comprises a tether element having one end attached to a surface of said cosmetic case and a second end attached to a personal device to which a user desires to attach said cosmetic case.

14. A portable cosmetic system for storing and carrying cosmetics comprising:

cosmetic case having a rectangular elongated shape with a top section and a bottom section, the top section and bottom section having an internal surface and external surface and edges of both sections that come together, the internal surfaces of said top and bottom sections each having concave shapes that form internal space between the top and bottom sections when edges of said top and bottom come together to enclosed any contents of said cosmetic case;

security structure in the internal space for securing cosmetic cartridges in the cosmetic case; and a plurality cosmetic cartridges for insertion, into said cosmetic case, said cartridges containing cosmetic materials and cosmetic utensils.

* * * * *